US011718506B2

(12) United States Patent
Talonen et al.

(10) Patent No.: US 11,718,506 B2
(45) Date of Patent: Aug. 8, 2023

(54) RESETTING A STATE IN AN ELEVATOR SYSTEM

(71) Applicant: Kone Corporation, Helsinki (FI)

(72) Inventors: Tapani Talonen, Helsinki (FI); Jari Kantola, Helsinki (FI)

(73) Assignee: Kone Corporation, Helsinki (FI)

( * ) Notice: Subject to any disclaimer, the term of this patent is extended or adjusted under 35 U.S.C. 154(b) by 857 days.

(21) Appl. No.: 16/663,704

(22) Filed: Oct. 25, 2019

(65) Prior Publication Data

US 2020/0156903 A1 May 21, 2020

(30) Foreign Application Priority Data

Nov. 15, 2018 (EP) ..... 18206379

(51) Int. Cl.

| | |
|---|---|
| ***B66B 13/22*** | (2006.01) |
| ***B66B 1/34*** | (2006.01) |
| ***B66B 5/00*** | (2006.01) |
| ***B66B 13/14*** | (2006.01) |

(52) U.S. Cl.

CPC ..... *B66B 13/22* (2013.01); *B66B 1/3415* (2013.01); *B66B 5/005* (2013.01); *B66B 5/0031* (2013.01); *B66B 13/14* (2013.01)

(58) Field of Classification Search

CPC ..... B66B 13/22; B66B 1/3415; B66B 5/0031; B66B 5/005; B66B 13/14; B66B 5/0018; B66B 1/3461; B66B 2201/4638

See application file for complete search history.

(56) References Cited

U.S. PATENT DOCUMENTS

| | | | | |
|---|---|---|---|---|
| 6,223,861 | B1 * | 5/2001 | Sansevero | B66B 13/22 187/316 |
| 6,603,398 | B2 * | 8/2003 | Tinone | B66B 13/22 187/390 |
| 9,403,663 | B2 * | 8/2016 | Dellarippa | B66B 5/0087 |
| 10,676,318 | B2 * | 6/2020 | Cortona | B66B 1/34 |
| 11,040,854 | B2 * | 6/2021 | Sudi | B66B 5/0006 |
| 2011/0155510 | A1 * | 6/2011 | Lindberg | B66B 5/005 187/314 |

(Continued)

FOREIGN PATENT DOCUMENTS

| | | |
|---|---|---|
| EP | 2072450 | 6/2009 |

OTHER PUBLICATIONS

European Search report, 18206379, dated May 22, 2019.

*Primary Examiner* — Jeffrey Donels

(74) *Attorney, Agent, or Firm* — Harness, Dickey & Pierce, P.L.C.

(57) ABSTRACT

The invention relates to a method for resetting a shaft access monitoring system of an elevator system. The method comprises: receiving an input from a user interface arranged in the elevator system, the input is provided with at least one input device of the user interface arranged to control an operation of the elevator system; comparing the received input to a reference value; and setting, in accordance with a comparison between the received input and the reference value, a detection result to express one of the following: (i) the shaft access monitoring system shall be reset, (ii) the shaft access monitoring system shall not be reset. The invention also relates to a control unit, to an elevator system and a computer program product.

27 Claims, 3 Drawing Sheets

(56) References Cited

U.S. PATENT DOCUMENTS

| | | | | |
|---|---|---|---|---|
| 2015/0251875 | A1* | 9/2015 | Lustenberger | B66B 5/0031<br>700/275 |
| 2016/0009525 | A1* | 1/2016 | DePaola | B66B 1/468<br>340/5.61 |
| 2017/0355559 | A1* | 12/2017 | Sonnenmoser | B66B 13/22 |

* cited by examiner

RESETTING A STATE IN AN ELEVATOR SYSTEM

RELATED APPLICATIONS

This application claims priority to European Patent Application No. EP18206379.2 filed on Nov. 15, 2018, the entire contents of which are incorporated herein by reference

TECHNICAL FIELD

The invention concerns in general the technical field of elevator systems. More particularly, the invention concerns a control of the elevator system.

BACKGROUND

Safety plays an important role in elevator systems. The elevator system comprises a plurality of safety solutions for different purposes. One utmost aim of the safety solutions is that the elevator system may operate in every special situation, such as in an emergency situation, so that passengers' safety may be safeguarded and damages to the elevator system may be minimized.

Naturally, it is important that safety solutions are regularly tested so that they operate in an expected manner when needed. As an example, so called shaft access monitoring system is tested once a year. The shaft access monitoring system refers to an implementation in which the status of the shaft doors is monitored with at least one safety circuit, which safety circuit typically comprises a plurality of safety switches used for detecting e.g. a position of landing door lock of the shaft. In case it is detected that one or more shaft doors are opened without the elevator car being at the same landing, the elevator system is set to such a state that the elevator is not operable by the car or landing call buttons. The state is maintained even if the opened door is closed until the state is reset in a predetermined manner.

The operation of the shaft access monitoring system as described above may be tested so that an emergency opening of the doors is carried out in every floor, which activates the shaft access monitoring system. Now, due to the fact that the doors are opened manually by a technician with a specific tool, the testing operation may turn out to be time consuming because after testing one landing door, the whole shaft access monitoring system needs to be reset and, in that manner, returned to a normal operating mode before testing the operation of the shaft access monitoring system on another floor level. The testing and resetting needs to be done floor-by-floor for every landing door of the elevator shaft. Usually, a button for shaft access monitoring reset is provided at a maintenance access panel of the elevator, located almost invariably at the top or bottom floor. Hence, the testing procedure entails a huge physical effort for the maintenance person due to the fact that the elevator cannot be used before resetting the shaft access monitoring status.

In some modern solutions a reset switch is arranged in an elevator car so that a resetting may be performed at each floor directly from the car immediately when the testing procedure is performed for the floor in question. This kind of implementation requires that an applicable cabling is arranged from the reset switch typically implemented on a car operating panel (COP) residing on a wall of the elevator car to e.g. safety switches of the shaft access monitoring system which switches are arranged to monitor a state of the shaft door, for example. Typically the reset switch is a so-called key switch for limiting an access to the switch for only those persons who have an applicable key to the switch. Naturally, having a specific switch and arranging the necessary cabling therein increase costs of the monitoring system which is not desirable. Moreover, there is need to make a visual design in such a manner that the reset switch may be included on the car operating panel with high quality.

Documents U.S. Pat. No. 6,223,861 B1 and U.S. Pat. No. 6,603,398 B2 introduce some prior art solutions for monitoring an access to an elevator shaft and safety solutions thereto.

Hence, there is need to develop solutions which mitigate the above described drawbacks at least in part.

SUMMARY

The following presents a simplified summary in order to provide basic understanding of some aspects of various invention embodiments. The summary is not an extensive overview of the invention. It is neither intended to identify key or critical elements of the invention nor to delineate the scope of the invention. The following summary merely presents some concepts of the invention in a simplified form as a prelude to a more detailed description of exemplifying embodiments of the invention.

An objective of the invention is to present a method, a control unit, an elevator system and a computer program product for controlling an elevator system. More specifically, the objective of the invention is that a shaft access monitoring system of an elevator system may be controlled.

The objectives of the invention are reached by a method, a control unit, an elevator system and a computer program product as defined by the respective independent claims.

According to a first aspect, a method for resetting a shaft access monitoring system of an elevator system is provided, the method comprising: receiving, by a control unit, an input from a user interface arranged in the elevator system, the input is provided with at least one input device of the user interface arranged to control an operation of the elevator system; comparing, by the control unit, the received input to a reference value; and setting, by the control unit, in accordance with a comparison between the received input and the reference value, a detection result to express one of the following: (i) the shaft access monitoring system shall be reset, (ii) the shaft access monitoring system shall not be reset.

The user interface used for providing the input may be accessible to a passenger of the elevator system.

The user interface may be arranged to at least one of the following: an elevator car, at least one landing floor.

Furthermore, the input may be given as a predetermined input pattern by activating at least one input device of the user interface. For example, the predetermined input pattern may be at least one of the following: simultaneous activation of a plurality of input devices, a consecutive activation of at least one input device, a gesture input with the user interface.

The method may further comprise, during the comparison step, a determination if the reference value is valid. The determination of a validity of the reference value may be performed by determining if a validity time of the reference value is run out.

Still further, the reference value may be generated in response to a receipt of a request for generating the reference value by the control unit.

According to a second aspect, a control unit for resetting a shaft access monitoring system of an elevator system is provided, the control unit comprising: at least one processor;

at least one memory including computer program code; the at least one memory and the computer program code configured to, with the at least one processor, cause the control unit to perform: receive an input from a user interface arranged in the elevator system, the input is provided with at least one input device of the user interface arranged to control an operation of the elevator system; compare the received input to a reference value; and set in accordance with a comparison between the received input and the reference value, a detection result to express one of the following: (i) the shaft access monitoring system shall be reset, (ii) the shaft access monitoring system shall not be reset.

The control unit may be arranged to perform, during the comparison step, a determination if the reference value is valid. The control unit may be arranged to perform the determination of a validity of the reference value by determining if a validity time of the reference value is run out.

The control unit may be arranged to generate the reference value in response to a receipt of a request for generating the reference value.

According to a third aspect, an elevator system is provided, the elevator system comprising: a shaft access monitoring system; a control unit; a user interface; wherein the elevator system: the control unit is arranged to receive an input from a user interface, the input is provided with at least one input device of the user interface arranged to control an operation of the elevator system; the control unit is arranged to compare the received input to a reference value, and to set, in accordance with a comparison between the received input and the reference value, a detection result to express one of the following: (i) the shaft access monitoring system shall be reset, (ii) the shaft access monitoring system shall not be reset.

The user interface of the elevator system used for providing the input may be arranged to be accessible to a passenger of the elevator system.

The user interface of the elevator system may be arranged to at least one of the following: an elevator car, at least one landing floor.

The elevator system may be arranged to activate at least one input device of the user interface for giving the input as a predetermined input pattern. For example, the predetermined input pattern may be at least one of the following: simultaneous activation of a plurality of input devices, a consecutive activation of at least one input device, a gesture input with the user interface.

The control unit of the elevator system may be arranged to perform, during the comparison step, a determination if the reference value is valid. For example, the control unit of the elevator system may be arranged to perform the determination of a validity of the reference value by determining if a validity time of the reference value is run out.

The control unit of the elevator system may be arranged to generate the reference value in response to a receipt of a request for generating the reference value.

According to a fourth aspect, a computer program product for resetting a shaft access monitoring system of an elevator system is provided which, when executed by at least one processor, cause a control unit to perform the method as described above.

The expression "a number of" refers herein to any positive integer starting from one, e.g. to one, two, or three.

The expression "a plurality of" refers herein to any positive integer starting from two, e.g. to two, three, or four.

Various exemplifying and non-limiting embodiments of the invention both as to constructions and to methods of operation, together with additional objects and advantages thereof, will be best understood from the following description of specific exemplifying and non-limiting embodiments when read in connection with the accompanying drawings.

The verbs "to comprise" and "to include" are used in this document as open limitations that neither exclude nor require the existence of unrecited features. The features recited in dependent claims are mutually freely combinable unless otherwise explicitly stated. Furthermore, it is to be understood that the use of "a" or "an", i.e. a singular form, throughout this document does not exclude a plurality.

BRIEF DESCRIPTION OF FIGURES

The embodiments of the invention are illustrated by way of example, and not by way of limitation, in the figures of the accompanying drawings.

DESCRIPTION OF THE EXEMPLIFYING EMBODIMENTS

The specific examples provided in the description given below should not be construed as limiting the scope and/or the applicability of the appended claims. Lists and groups of examples provided in the description given below are not exhaustive unless otherwise explicitly stated.

Figure 1:
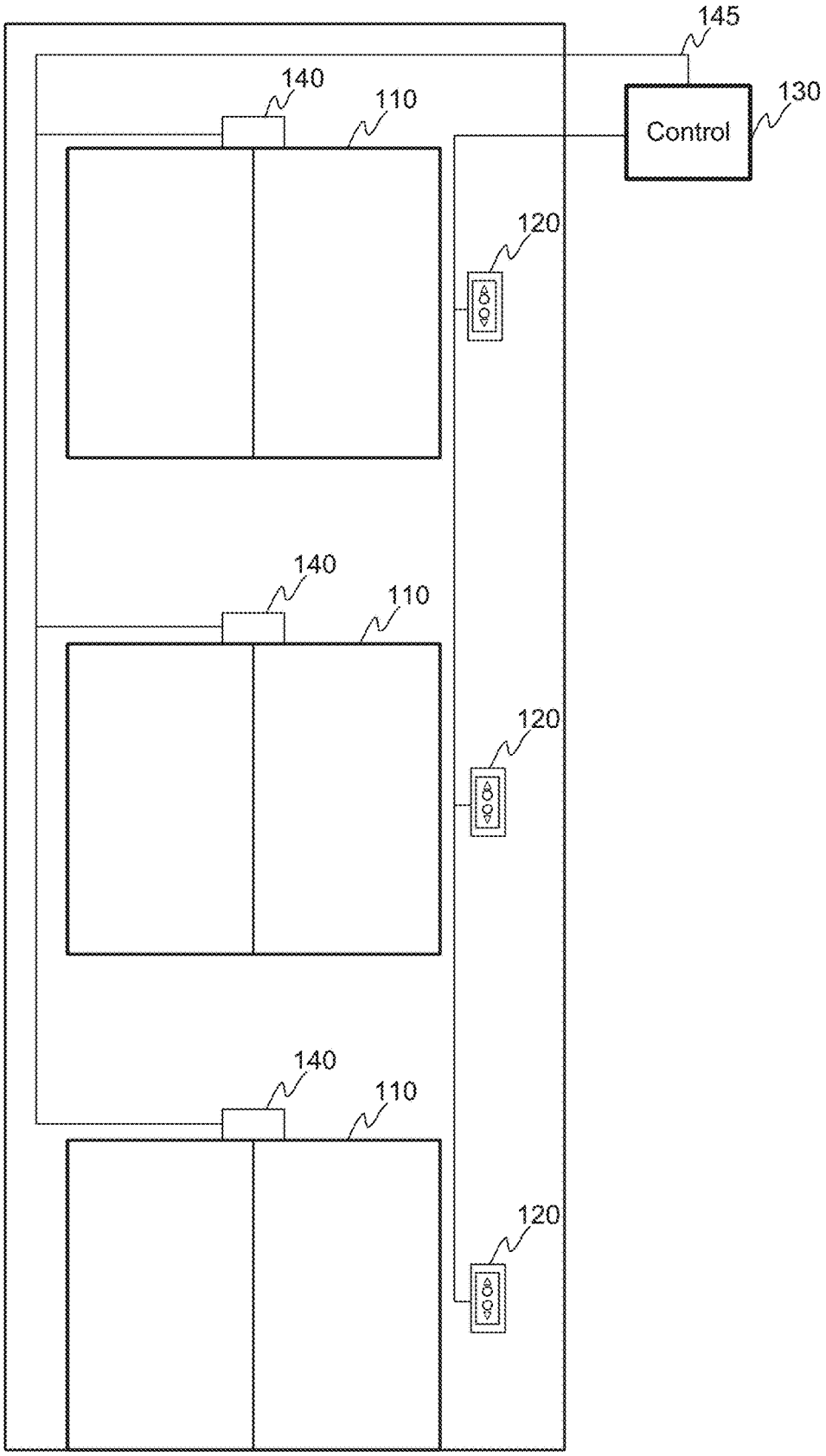
FIG. 1 illustrates schematically at least a part of an elevator system according to an embodiment of the invention.

FIG. 1 illustrates schematically at least a part of an elevator system according to an embodiment of the invention. One or more elevator cars are arranged to travel in one or more shafts which may be accessed at least through shaft doors 110 at landing floors. At landing floors there may be arranged one or more user interfaces 120 for providing instructions to the elevator system. The instruction may relate to a provision of elevator calls to the elevator system or instructing an operation of the shaft doors 110, such as opening or closing those. The operation of the elevator system may, at least in part, be controlled with a control unit 130 which may receive any signal from the user interface and generate signal to door motors of the shaft doors 110.

Moreover, FIG. 1 illustrates schematically a safety circuit 145 for monitoring shaft access as a shaft access monitoring system. This may e.g. be implemented so that state of the shaft doors 110 are monitored with sensors 140 arranged to generate signals from which it is possible to derive information on the states of the doors 110. The signals may be conveyed to the control unit 130 which may perform an analysis of the signals. According to an embodiment of the present invention the safety circuit 145 may be implemented with a communication bus by means of which it is possible to utilize sensors as well as to convey rich information between the entities coupled to the communication bus. For example, the communication bus may be a part of so-called Programmable Electronic Systems in Safety-related Applications for Lifts (PESSRAL) which may be applied in the context of the present invention. In response to a detection by the control unit 130 that the signals comprise data indicating that so-called emergency opening of at least one shaft door 110 is performed the elevator system is set, by the shaft access monitoring system, to such a state that the elevator is not operable by the car or landing call input devices implemented in the user interfaces. Alternatively or in addition, the safety circuit, i.e. the shaft access monitoring system, may comprise a dedicated control unit for controlling the operation of the safety circuit at least in part, and to communicate with the control unit 130 of the elevator system. The safety circuit may comprise further devices and arrangements not disclosed herein.

Figure 2:
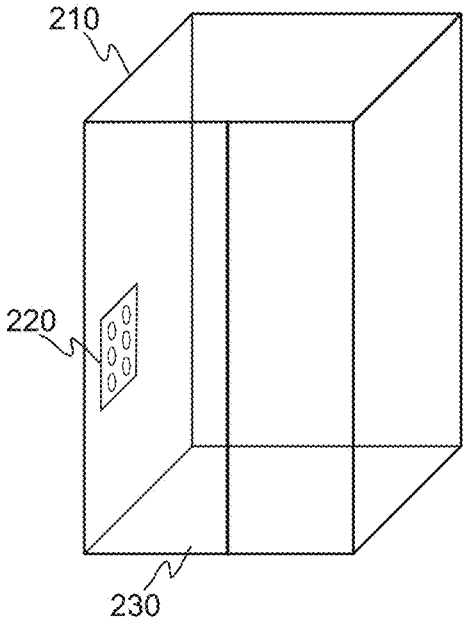
FIG. 2 illustrates schematically at least a part of an elevator car belonging to an elevator system according to an embodiment of the invention.

FIG. 2, in turn, illustrates schematically at least a part of an elevator car 210 belonging to the elevator system according to an embodiment of the invention. The elevator car may also comprise a user interface 220 for providing information to and from the elevator system. The user interface 220 may refer to a car operating panel at least to some extent. In FIG. 2 it is also disclosed doors 230 of the elevator car 210. Again, the control unit 130 as illustrated in FIG. 1 may be arranged to communicate with the entities of the elevator car, such as with the user interface 220 and door motors of the elevator car doors 230, so that the entities and the elevator system may be controlled.

Figure 3:
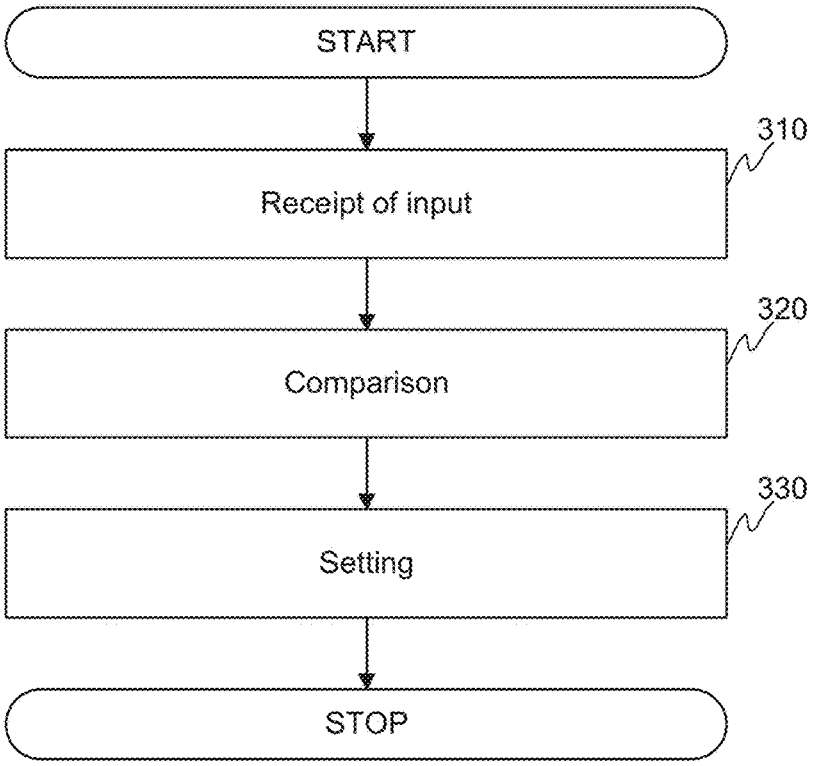
FIG. 3 illustrates schematically a method according to an embodiment of the invention.

A method for resetting a shaft access monitoring system of an elevator system according to an embodiment of the invention is schematically illustrated in FIG. 3. The resetting of the access monitoring system is needed for bringing the elevator system to a normal operation state in response to the state which limits the operation of the elevator system due to a detection of an emergency opening of at least one shaft door 110. The opening may e.g. occur during a test procedure of the elevator system or in response to an emergency situation. According to an embodiment of the present invention the resetting of the shaft access may be arranged with a signal given by at least one user interface 120, 220 of the elevator system. The signal resetting the access monitoring system may be generated in response to an input given through at least one input device of the user interface 120, 220. In other words, a signal carrying data indicating an input given with the user interface may be received 310 by a control unit 130.

In response to a receipt of the signal the control unit 130 may be configured to compare 320 the received input to a reference value. As mentioned at least one aim of the method according to the embodiment of the present invention is that the access monitoring system may be reset. Hence, the reference value is defined so that it corresponds to a value by means of which it may be concluded, through the comparison 320, that the data carried in the received signal indicates that the resetting is requested.

Hence, in response to the comparison 320 the control unit 130 may be arranged to set 330, in accordance with a comparison between the received input and the reference value, a detection result to express one of the following: (i) the shaft access monitoring system shall be reset, (ii) the shaft access monitoring system shall not be reset. The setting of the detection result may comprise a generation of an indication, such as a flag, expressing the above. The generated indication may cause a generation of a signal which causes the resetting of the shaft access monitoring system.

As mentioned above the user interface 120, 220 may be implemented with any applicable manner. The user interface may be implemented with one or more buttons, with at least one keyboard, with at least one touch screen or with any other device by means of which it is possible to provide input to the elevator system. As a non-limiting example of applicable input device an elevator call button of an elevator residing e.g. on a landing floor or a destination call button residing e.g. inside the elevator car may be mentioned. Moreover, the input device may be such that it controls doors of the elevator system, such as the doors of the elevator car or the shaft doors. Still further, the input device may be emergency stop button of the elevator car, for example. Generally speaking the term user interface shall be understood also to cover e.g. any applicable device, which may operate as the user interface, such as a mobile terminal device coupled to the elevator system, and to the control unit therein, which mobile terminal device may be arranged to execute a user interface application of the elevator system.

According to the present invention the input device of the user interface 120, 220 may be such that the input device is available for a passenger of the elevator car. This refers to an implementation in which the input device is such that it is not secured at least with mechanical means, e.g. so that the input device does not need any key or similar to be used for the purpose of resetting the shaft access monitoring system.

The input for resetting the shaft access monitoring system may advantageously be defined so that it may be indicated with the input device of the user interface 120, 220. Advantageously, the input causing the resetting of the shaft access monitoring system is defined in advance and is represented with the reference value. The reference value may advantageously be selected so that a passenger, or any other person, does not give it in a normal use of the elevator, or a probability of giving an input corresponding to the reference value is low, or the resetting of the shaft access monitoring system is not enabled when the state of the elevator is not the emergency state (cf. emergency opening of the doors). According to an embodiment of the invention the input may be given with a single input device wherein the input has a predetermined pattern. The pattern may refer to a push of the button sequentially so that it activates, i.e. generates a signal, a plurality of times. It may e.g. be defined that the sequential activations shall occur within a predetermined period of time in order to distinguish it from other activations, such as from normal use of the input device. Alternatively or in addition, the request to reset the shaft access monitoring system may be indicated with a continuous activation of the input device i.e. it is kept activated for a predetermined continuous period of time which generates a corresponding signal patter for comparing it with the reference value. In some other embodiment the input for resetting the shaft access monitoring system may be given with a plurality of input devices of the user interface 120, 220. In this kind of arrangement the input may be given with a predetermined combined activation with the plurality of input device. This kind of combined activation may e.g. be achieved by activating a plurality of input device of one or more user interfaces 120, 220 simultaneously at least in part or consecutively to each other in a predetermined order. Still further, in case the user interface 120, 220 is implemented with a touch screen it may be arranged that a certain gesture receivable with the user interface 120, 220 may be defined as the reference value. Thus, when the control unit 130 receives the input i.e. a gesture given with the touch screen, the control unit 130 may be arranged the signal representing the input gesture with the reference value and set the detection result according to the comparison.

Advantageously, the technician when testing the elevator system, and specifically the operation of the shaft access monitoring system, is aware of the input pattern by means of which the resetting of the shaft access monitoring system may be achieved. However, an embodiment of the invention may be arranged so that the reference value stored in the system and to be used for the comparison may be changed either automatically or manually. For example, it may be arranged that the control unit 130 is arranged to generate a random reference value inputtable with one or more input devices of the one or more user interfaces in response to a request which generated reference value may be stored in data storage accessible to the control unit 130. Further, the control unit 130 may be arranged to deliver the generated reference value, i.e. the correct input for resetting the shaft access monitoring system, to the technician in a predetermined manner. For example, the control unit 130 may be communicatively coupled to data center. In this kind of implementation the control unit 130 may deliver the generated reference value to the data center wherefrom the generated reference value may be delivered to the technician, e.g. to a terminal device of the technician, who is instructed to perform the testing procedure of the shaft access monitoring system. Alternatively, it may be arranged so that the technician when entering the site connects to the control unit 130 which may retrieve the generated reference value from the data storage or the control unit 130 may be arranged to perform the generation of the reference value in response to a communication with a technician, i.e. the terminal device of the technician, at the site. In this manner it is possible to enhance the security of the present invention because the reference value is changing. According to a further embodiment of the invention the control unit 130 may be arranged to set a validity time to the generated reference value which also improves safety of the solution according to the present invention. The validity time may be calculated by the control unit 130 by means of a timer implemented in the control unit 130. As shall be understood from above the technician when being aware of the reference value may provide an input corresponding to the reference value with the input device of the user interface.

Figure 4:
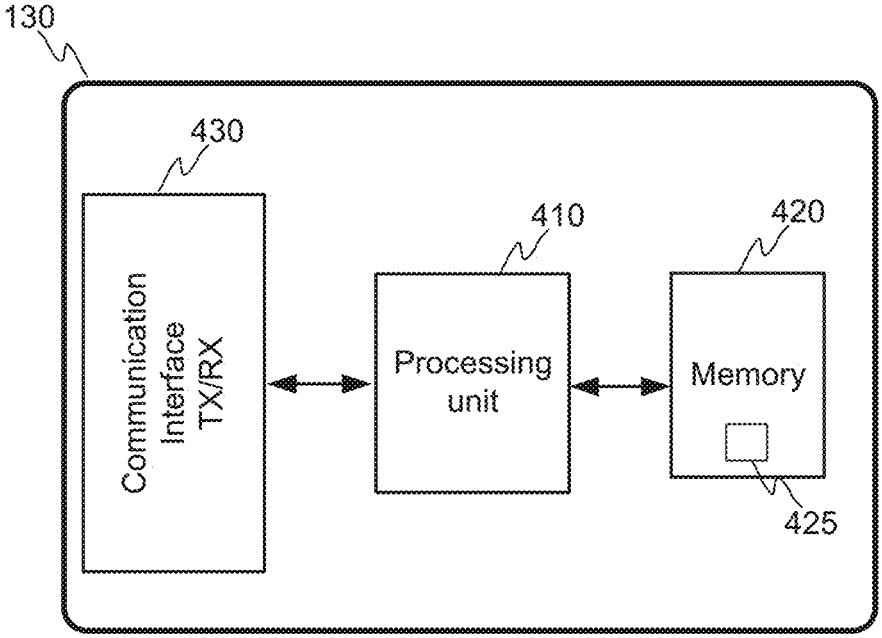
FIG. 4 illustrates schematically a control unit according to an embodiment of the invention.

FIG. 4 schematically illustrates a control unit 130 according to an embodiment of the invention. The control unit 130 may comprise a processing unit 410, a memory 420 and a communication interface 430 among other entities. The processing unit 410, in turn, may comprise one or more processors arranged to implement one or more tasks for implementing at least part of the method steps as described. For example, the processing unit 410 may be arranged to perform the monitoring task for the shaft access monitoring system and in response to a detection of an opening of the shaft doors the elevator system is set to a state limiting an operation of the elevator system as described. Further, the processing unit 410 may be arranged to receive an input and compare it to a reference value obtainable e.g. from the memory 420, i.e. from data storage and set a detection result in accordance with the comparison. The memory 420 may be arranged to store computer program code which, when executed by the processing unit 410, cause the control unit 130 to operate as described. Moreover, the memory 420 may be arranged to store, as described, the reference value 425, and any other data. The communication interface 430 may be arranged to implement, e.g. under control of the processing unit 410, one or more communication protocols enabling the communication with external entities as described. The communication interface may comprise necessary hardware and software components for enabling e.g. wireless communication and/or communication in a wired manner.

The invention as described may provide advantages compared to the prior art solutions in a sense that it simplifies an implementation of an elevator system, and especially the shaft access monitoring system. This is because the present invention enables utilization of user interface intended for passenger use for resetting the shaft access monitoring system. As a result, there is no need to implement secured mechanical solutions for the purpose of resetting the shaft access monitoring system.

The specific examples provided in the description given above should not be construed as limiting the applicability and/or the interpretation of the appended claims. Lists and groups of examples provided in the description given above are not exhaustive unless otherwise explicitly stated.

What is claimed is:

1. A method of resetting a shaft access monitoring system of an elevator system, the method comprising:

receiving an input from a user interface, the user interface configured to receive elevator calls of the elevator system;

analyzing the input received from the user interface and a reference value to distinguish the elevator calls from a command to reset the shaft access monitoring system; and selectively resetting the shaft access monitoring system based on a result of the analyzing.

2. The method of claim 1, wherein the user interface is accessible to a passenger of the elevator system such that the input associated with resetting the shaft access monitoring system and the input associated with the elevator calls are both receivable from the passenger.

3. The method of claim 2, wherein the user interface is accessible to the passenger via at least one of an elevator car and at least one landing floor of the elevator system.

4. The method of claim 1, wherein the selectively resetting comprises:

determining whether the input received via the user interface satisfies a set input pattern; and resetting the shaft access monitoring system, in response to the input received via the user interface satisfying.

5. The method of the claim 4, wherein determining whether the input received via the user interface satisfies the set input pattern comprises:

determining whether the input received via the user interface includes at least one of simultaneous activation of a combination of a plurality of inputs associated with the user interface, a consecutive activation of the combination of the plurality of inputs, a gesture input with the user interface.

6. The method of claim 1, further comprising:

determining whether the reference value is valid.

7. The method of claim 6, wherein the determining whether the reference value is valid comprises:

determining whether the reference value is valid based on whether the reference value is expired.

8. The method of claim 1, further comprising:

generating the reference value on demand in response to a request.

9. A non-transitory computer readable medium storing instructions which, when executed by a controller, configure the controller to perform the method of resetting a shaft access monitoring system according to claim 1.

10. The method of claim 1, wherein the selectively resetting includes selectively resetting a flag associated with the shaft access monitoring system based on the result of the analyzing.

11. The method of claim 10, wherein, in response to resetting the flag, operation of an elevator car associated with the elevator calls receivable via the user interface is permitted such that the shaft access monitoring system is repeatedly resettable from a user located at different ones of a plurality of landing floors.

12. A controller configured to reset a shaft access monitoring system of an elevator system, the controller comprising:

an input/output (I/O) device configured to communicate with a user interface, the user interface configured to receive elevator calls of the elevator system; and at least one processor configured to, receive an input from the user interface, analyze the input received from the user interface and a reference value to distinguish the elevator calls from a command to reset the shaft access monitoring system to generate an analysis result, and selectively reset the shaft access monitoring system based on the analysis result.

13. The controller of claim 12, wherein the controller is configured to determine whether the reference value is valid.

14. The controller of claim 13, wherein the controller is configured to determine whether the reference value is valid based on whether the reference value is expired.

15. The controller of claim 12, wherein the controller is configured to generate the reference value on demand in response a request.

16. The controller of claim 12, wherein the at least one processor is configured to, selectively reset a flag associated with the shaft access monitoring system based on the analysis result.

17. The controller of claim 16, wherein, in response to resetting the flag, operation of an elevator car associated with the elevator calls receivable via the user interface is permitted such that the shaft access monitoring system is repeatedly resettable from a user located at different ones of a plurality of landing floors.

18. An elevator system, comprising:

a user interface configured to receive elevator calls of the elevator system; and a shaft access monitoring system including a controller configured to, receive an input from the user interface, analyze the input received from the user interface and the reference value to distinguish the elevator calls from a command to reset the shaft access monitoring system to generate an analysis result, and selectively reset the shaft access monitoring system based on the analysis result.

19. The elevator system of claim 18, wherein the user interface of the elevator system is accessible to a passenger of the elevator system such that the input associated with resetting the shaft access monitoring system and the input associated with the elevator calls are both receivable from the passenger.

20. The elevator system of claim 18, wherein the user interface is accessible to a passenger via at least one of an elevator car and at least one landing floor of the elevator system.

21. The elevator system of claim 18, wherein the controller is configured to, determine whether the input received via the user interface satisfies a set input pattern; and reset the shaft access monitoring system, in response to the input received via the user interface satisfying the set input pattern.

22. The elevator system of the claim 21, wherein the controller is configured to determine whether the input received via the user interface satisfies the set input pattern by, determining whether the input received via the user interface includes at least one of simultaneous activation of a combination of a plurality of inputs associated with the user interface, a consecutive activation of the combination of the plurality of inputs, a gesture input with the user interface.

23. The elevator system of claim 18, wherein the controller is configured to determine whether the reference value is valid.

24. The elevator system of the claim 23, wherein the controller is configured to determine whether the reference value is valid based on whether the reference value is expired.

25. The elevator system of claim 18, wherein the controller is configured to generate the reference value on demand in response to a request.

26. The elevator system of claim 18, wherein the controller is configured to, selectively reset a flag associated with the shaft access monitoring system based on the analysis result.

27. The elevator system of claim 26, wherein, in response to resetting the flag, operation of an elevator car associated with the elevator calls receivable via the user interface is permitted such that the shaft access monitoring system is repeatedly resettable from a user located at different ones of a plurality of landing floors.

* * * * *